US010220587B2

(12) United States Patent
Cay et al.

(10) Patent No.: US 10,220,587 B2
(45) Date of Patent: Mar. 5, 2019

(54) MODULE COMPRISING A FRAME AND FOLDER/GLUER THUS EQUIPPED

(71) Applicant: BOBST MEX SA, Mex (CH)

(72) Inventors: Erhan Cay, Renens (CH); Cédric Heiniger, Savigny (CH); Roberto Valterio, Ollon (CH)

(73) Assignee: BOBST MEX SA (CH)

( * ) Notice: Subject to any disclaimer, the term of this patent is extended or adjusted under 35 U.S.C. 154(b) by 600 days.

(21) Appl. No.: 14/396,593

(22) PCT Filed: Apr. 16, 2013

(86) PCT No.: PCT/EP2013/001121

§ 371 (c)(1),
(2) Date: Oct. 23, 2014

(87) PCT Pub. No.: WO2013/159876

PCT Pub. Date: Oct. 31, 2013

(65) Prior Publication Data

US 2015/0298417 A1 Oct. 22, 2015

(30) Foreign Application Priority Data

Apr. 23, 2012 (EP) ..... 12002845

(51) Int. Cl.

| | |
|---|---|
| ***B31B 50/00*** | (2017.01) |
| *B44B 5/00* | (2006.01) |
| *B31B 50/88* | (2017.01) |

(52) U.S. Cl.

CPC ..... *B31B 50/00* (2017.08); *B31B 50/005* (2017.08); *B31B 50/88* (2017.08); *B31F 2201/0782* (2013.01); *B44B 5/0047* (2013.01)

(58) Field of Classification Search

CPC ..... B31B 1/88; B31B 1/00; B31B 2201/88; B31B 2201/94; B31B 50/00; B31B 50/88;
(Continued)

(56) References Cited

U.S. PATENT DOCUMENTS 3,611,957 A * 10/1971 Beazley ..... B65H 3/20 112/470.36
6,503,181 B1 * 1/2003 Pons ..... B65H 5/023 198/419.2

(Continued)

FOREIGN PATENT DOCUMENTS

| | | |
|---|---|---|
| DE | 10 2007 044827 A1 | 5/2008 |
| EP | 1 932 657 | 6/2008 |
| EP | 2 422 993 A2 | 2/2012 |

OTHER PUBLICATIONS

International Search Report dated Jul. 4, 2013 issued in corresponding International patent application No. PCT/EP2013/001121.

*Primary Examiner* — Sameh Tawfik
(74) *Attorney, Agent, or Firm* — Ostrolenk Faber LLP

(57) ABSTRACT

A module for a folder-gluer (1) includes a frame (13) having two substantially vertical front and rear walls (14, 16) and at least one functional arrangement (28, 33) held by the frame (13), at least one transverse element (17, 18), mechanically connecting and maintaining parallelism between the first and rear walls (14, 16) and the transverse element is configured with at least one substantially horizontal portion forming an apron (19), which is configured to permit an operator (30) to climb onto the frame and to access the functional arrangement (28, 33).

13 Claims, 3 Drawing Sheets

(58) Field of Classification Search
CPC ..... B31B 50/005; B31F 2201/0782; B44B 5/0047
USPC ..... 493/162
See application file for complete search history.

(56) References Cited

U.S. PATENT DOCUMENTS

| | | | | |
|---|---|---|---|---|
| 7,172,546 | B2 * | 2/2007 | Fiedler | B31B 19/00 493/162 |
| 7,258,655 | B2 * | 8/2007 | Saro | B31B 1/00 493/142 |
| 7,794,379 | B2 * | 9/2010 | Diehr | B31F 1/07 493/160 |
| 8,550,970 | B2 * | 10/2013 | Panepinto | B31B 1/00 493/128 |
| 2011/0294637 | A1 * | 12/2011 | Muller | B31B 1/00 493/23 |
| 2012/0048131 | A1 * | 3/2012 | Diehr | B31F 1/07 101/3.1 |
| 2012/0058873 | A1 * | 3/2012 | Babcock | B31B 1/00 493/53 |

* cited by examiner

MODULE COMPRISING A FRAME AND FOLDER/GLUER THUS EQUIPPED

CROSS-REFERENCE TO RELATED APPLICATIONS

The present application is a 35 U.S.C. §§ 371 National Phase conversion of PCT/EP2013/001121, filed Apr. 16, 2013, which claims priority of European Patent Application No. 12002845.1, filed Apr. 23, 2012, the contents of which are incorporated by reference herein. The PCT International Application was published in the French language.

TECHNICAL FIELD

The present invention relates to a module comprising a frame, more particularly designed for a folder-gluer. The invention further relates to a folder-gluer equipped with such a module.

TECHNICAL BACKGROUND

In the packaging industry, the manufacture of boxes is carried out in line, by folding and gluing cardboard blanks by means of machines called folder-gluers. A folder-gluer comprises a series of modules and stations, each comprising functional arrangements. The number of modules varies according to the complexity of the manufacturing operations which the selected type of box requires.

The folder-gluer is equipped with a feeder supplying the machine with successive blanks from a stack, an alignment module, a breaker pre-breaking the non-longitudinal folds, folding devices with hooks which fold the front flaps and then the rear flaps of the blank, a gluing station, a folding device for folding the longitudinal folds of the blank, a press which compresses all of the folds and deposits the boxes in a shingled stream and a delivery module which receives the boxes while keeping the boxes compressed to permit the glue to dry.

The conveyance of the blanks from one station to another along a substantially planar and horizontal trajectory is carried out using belt conveyors which, by means of friction, grip the blanks between a lower conveyor and an upper conveyor. The lower conveyor is provided with lower belts and the upper conveyor is provided either with upper belts or upper support rollers.

To meet certain regulations in terms of information intended for people of poor sight or blind people, it has become necessary to print messages in braille characters on certain packaging boxes, in particular on boxes for medication. The braille characters are embossed on a surface of the box enabling the dots in relief or protuberances to appear, permitting tactile reading of the messages.

PRIOR ART

An example from the prior art of embossing carried out using a module for embossing braille characters in a folder-gluer is revealed in the document EP 1932657.

The module comprises a principal frame essentially formed from two vertical front and rear walls, kept apart from one another by a plurality of spacers. The module comprises conveyors for transporting the blanks. The module comprises a device associated with the principal frame to emboss the braille characters on the cardboard blanks traveling in the module and thus in the folder-gluer.

Before production, the operator works on the folder-gluer to carry out routine adjustments to the functional arrangements or more important modifications which depend on the type of blank having to be folded. Wear parts such as belts, rollers and the like have to be replaced.

During production, the operator is also obliged to stop the folder-gluer in order to be able to remove a jammed blank, to carry out a further adjustment to the position of certain parts, to clean the functional arrangements or even to change the broken parts.

The operator leans over the vertical wall of the frame to access the parts and the functional arrangements. In certain folders-gluers of significant length, the operator has to pass around the machine in order to access the rear parts, which requires the operator to move over a minimum distance of 20 meters. In certain folder-gluers provided for blanks of large width, for example of 3000 mm, the operator has to straddle one of the front or rear walls in order to squeeze into and enter the space between the two walls.

All these maintenance operations prove impractical, increasing the adjustment time and stoppage time of the folder-gluer, and are sources of error, thus increasing the fatigue of the operator. During these stoppage periods, the folder-gluer is no longer in production.

SUMMARY OF THE INVENTION

A principal object of the present invention consists in developing a module for a folder-gluer comprising a frame. A second object is to produce a frame permitting easy access for an operator. A third object is to make the maintenance operations of the modules of a folder-gluer more ergonomic. A fourth object is to resolve the technical problems mentioned above relative to the document of the prior art. A further object is that of producing a folder-gluer with a module and more particularly a module for embossing braille characters.

A module for a folder-gluer comprises a frame having two substantially vertical front and rear walls and at least one functional arrangement held by the frame.

According to one feature of the present invention, the module is characterized in that the frame further comprises at least one transverse element, mechanically connecting and maintaining a parallelism between the two walls and configured with at least one substantially horizontal portion forming an apron, so as to permit an operator to climb onto the frame and to access the functional arrangement.

In other words, therefore, the transverse element or elements play two principal roles. The first role is to form the entire frame with the front wall and the rear wall, by combining them. The mechanical stresses are supported by the walls and the transverse element or elements.

The second role is to permit easy access to the functional arrangement or arrangements. The portion forming an apron has capacities of mechanical strength which enable it to support the weight of the operator. The frame is designed in turn to constitute a podium or part of a podium or the like. The portion forming an apron is similar to a walkway or a platform. The operator transfers his weight on the portion forming an apron by placing a foot or both feet or a knee or both knees there or by being seated there, and will easily access the functional arrangement and the constituent parts thereof.

The module is defined as being a sheet feeder, an alignment module, a module for embossing braille characters, a printing module, a folder module with hooks, a quality control module, a gluing station, a press, a shingling module, a delivery module, and still other.

The functional arrangement is defined as being a working device and the constituent parts thereof which are present in a folder-gluer, generating an action on the blanks, of the tool, detector or conveyor type, such as a gripping device, a device for embossing braille characters, a printing unit, a sensor, a detection camera, a breaker for pre-breaking the folds, a hook for folding, a gluing unit, an ejector, a blank counter, a conveyor, an endless drive belt, an endless drive conveyor belt, support rollers and still other.

The front is defined relative to the front face of the machine, on the side of the podium for controlling the machine, known by the term "operator's side". The rear is defined relative to the rear face of the machine, on the side opposing the podium for controlling the machine, known by the term "opposite operator's side".

In a further feature of the invention, a folder-gluer is characterized in that it is equipped with at least one module having one or more technical features which are disclosed below and claimed.

BRIEF DESCRIPTION OF THE DRAWINGS

The invention will be easily understood and the various advantages and different features thereof will be revealed more clearly in the following description of the non-limiting embodiment, with reference to the accompanying schematic drawings, in which.

DETAILED DESCRIPTION OF THE PREFERRED EMBODIMENTS

Figure 1:
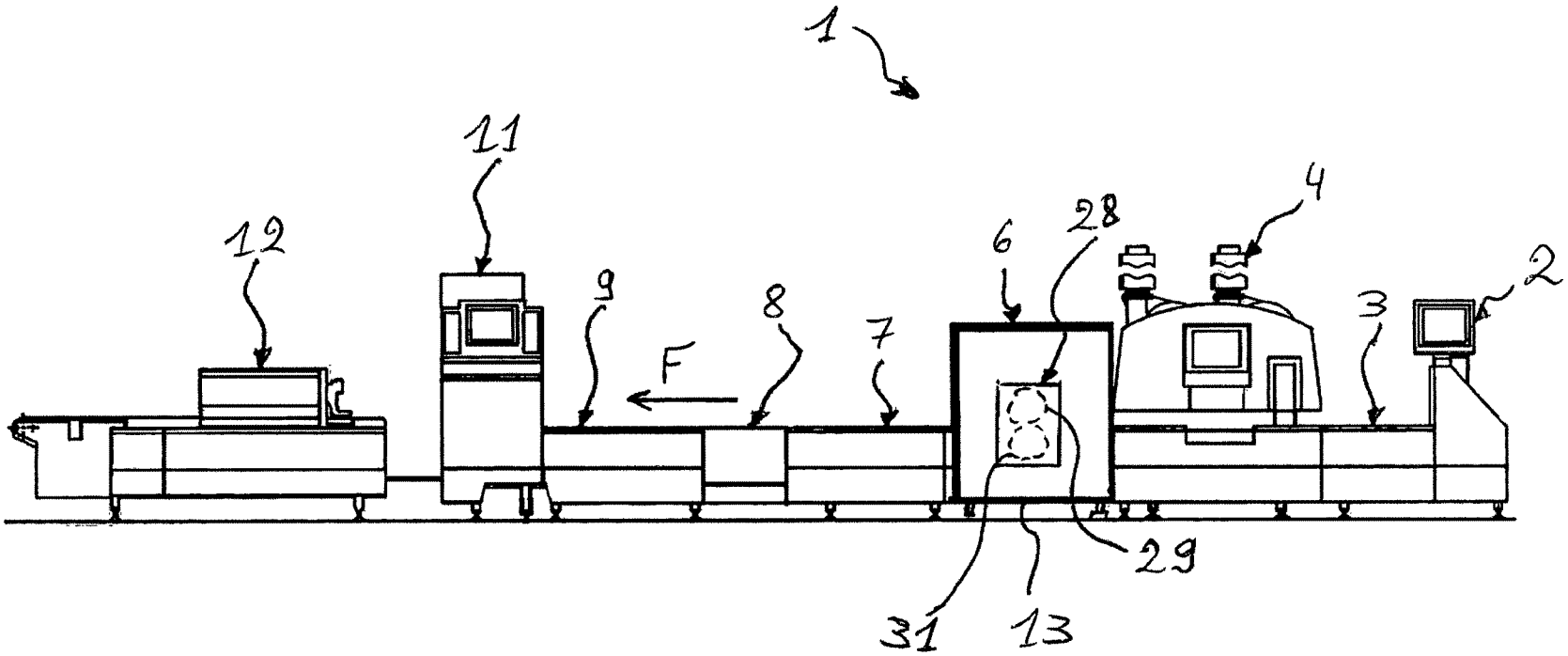
FIG. 1 shows a synoptic side view of a folder-gluer of modular structure.

As FIG. 1 illustrates, a folder-gluer 1 is provided with a modular structure. The upstream and downstream positions are defined relative to the longitudinal direction and to the direction of travel of the blanks (arrow F in FIGS. 1 and 2) from the inlet of the folder-gluer 1 to the outlet of the folder-gluer 1.

The folder-gluer 1 is equipped successively from upstream to downstream with a sheet feeder 2, an alignment module 3, an in-line quality control device 4, a module for embossing braille characters 6, a pre-breaking module 7, a gluing station 8, a folding module 9, a transfer module 11 and a delivery module 12.

Figure 2:
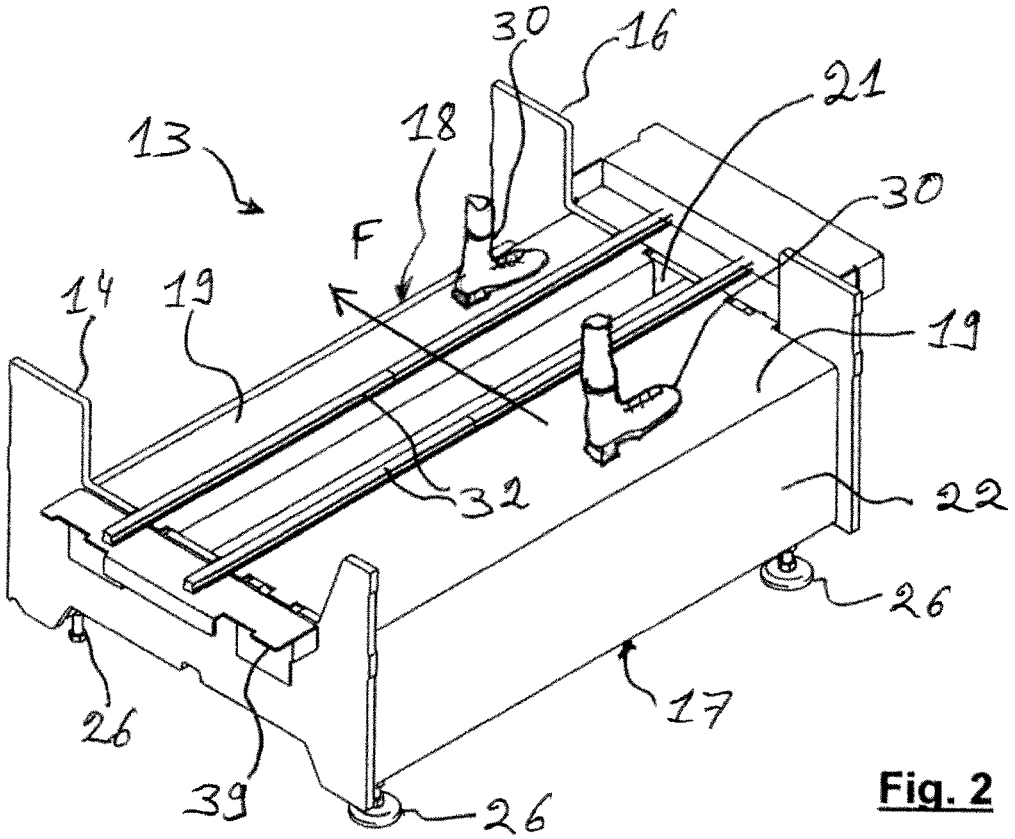
FIG. 2 shows a perspective view of the frame of a module according to the invention.
Figure 3:
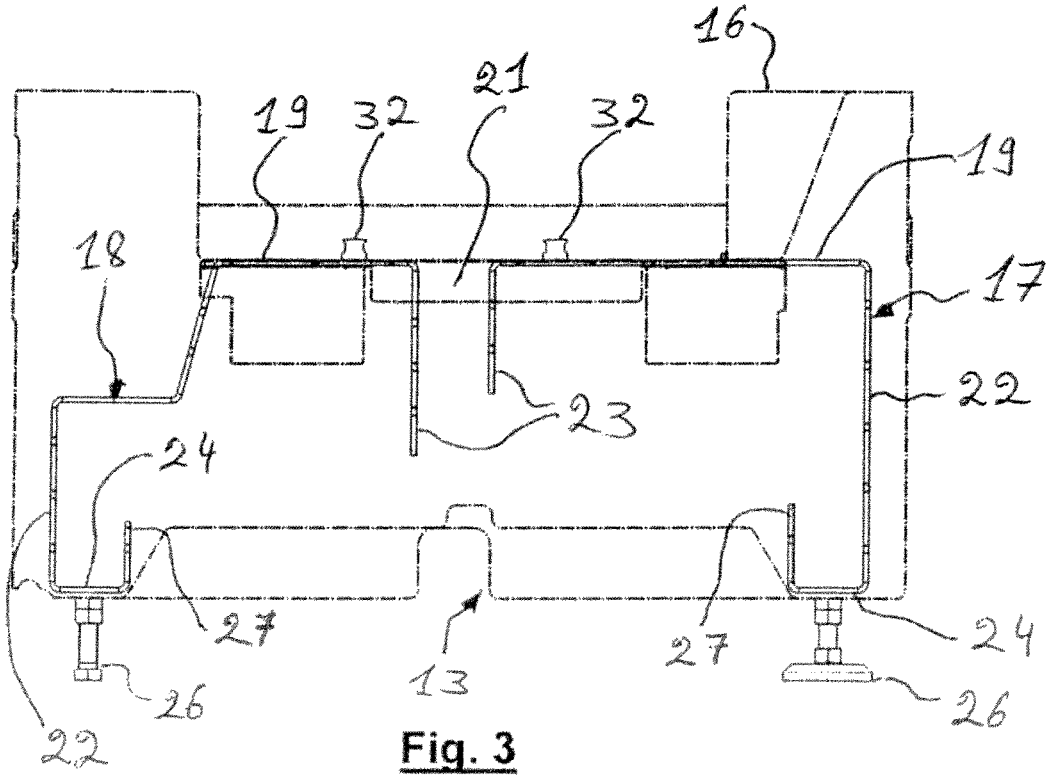
FIG. 3 shows a longitudinal sectional view of the frame of FIG. 2.
Figure 4:
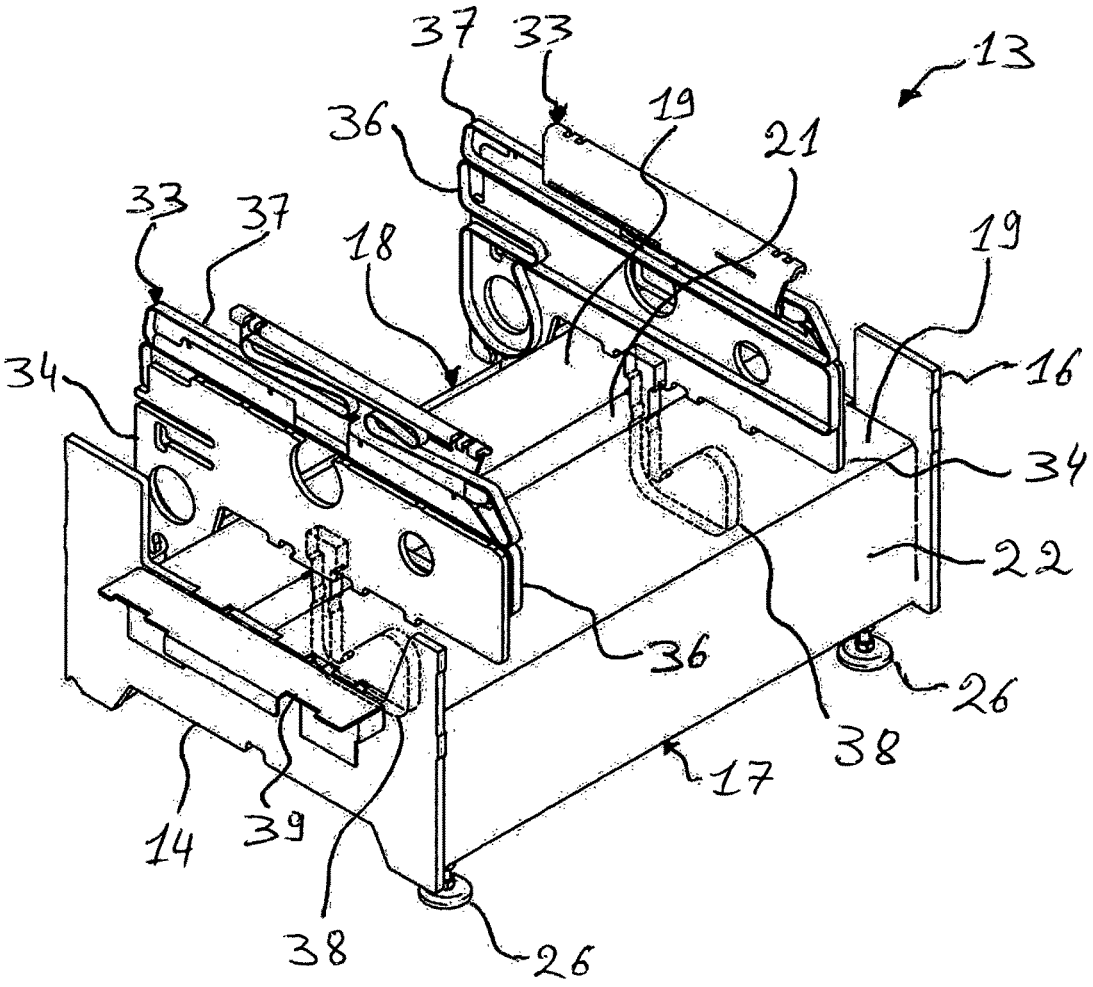
FIG. 4 shows a perspective view of the frame of FIG. 2, with two conveyors in the resting position.

The embossing module 6 comprises a frame 13. The frame 13 has a substantially vertical front wall 14. The frame 13 has a substantially vertical rear wall 16. According to the invention and as FIGS. 2 to 4 show, the frame 13 comprises at least one element, in this case two transverse elements 17 and 18. A first transverse element 17 is mounted on the upstream side of the module 6. A second transverse element 18 is mounted on the downstream side of the module 6.

The two transverse elements 17 and 18 mechanically connect the two was 14 and 16 together. The two transverse elements 17 and 18 hold the two walls 14 and 16 parallel to one another. At least one of the two transverse elements 17 and 18, and in this case the two transverse elements 17 and 18, are configured with at least one substantially horizontal portion forming an apron 19. The apron 19 is a portion of the transverse element 17 and 18 substantially parallel to the plane defined by the direction of travel F of the blanks. The apron 19 is flush with one of the upper edges of one or both walls 14 and 16.

The transverse elements 17 and 18 are preferably provided separated from one another, leaving a slot 21. The slot 21 extends transversely and is centered relative to the walls 14 and 16 and relative to the frame 13. The slot 21 is delimited by the lower end of the apron 19 of each of the two transverse elements 17 and 18. The slot 21 opens up the volume below the apron 19 of each of the two transverse elements 17 and 18. A slot may also be formed in the apron of just one transverse element.

The transverse element 17 and 18 is advantageously in the form of a folded plate (see FIG. 3) incorporating the apron 19. The production of the transverse element 17 and 18 with a mechanically welded structure is also possible. Advantageously, the transverse element 17 and 18 has a profile substantially in the shape of a reverse L-shape. A first portion of the reverse L-shape forms the apron 19. A second portion 22 of the reverse L-shape is substantially perpendicular to the apron 19. The second portion 22 is oriented vertically and directed towards the ground.

The second portion 22 of the L-shape forms a transverse plate closing the frame 13, on the upstream side for the first upstream transverse element 17. The apron 19 extends downstream from the second portion 22 of the first upstream transverse element 17. The second portion 22 of the L-shape forms a transverse plate closing the frame 13 on the downstream side for the second downstream transverse element 18. The apron 19 extends upstream from the second portion 22 of the second downstream transverse element 18.

For additional rigidity, a fold forming a first side extension 23 is provided (see FIG. 3) in the region of and extending the inner end of the apron 19 of each of the two transverse elements 17 and 18. The first side extension 23 extends perpendicular to the apron 19. The first side extension 23 is oriented vertically and directed towards the ground. This first side extension 23 of each of the two transverse elements 17 and 18 delimits the entrance to the slot 21. The first side extension 23 of the first upstream transverse element 17 extends the apron 19 on the downstream side and faces the first side extension 23 of the second downstream transverse element 18 which extends the apron 19 on the upstream side.

For additional rigidity, a fold forming a second side extension 24 is provided (see FIG. 3) in the region of the lower end of the second portion 22 of each of the two transverse elements 17 and 18. The second side extension 24 extends perpendicular to the second portion 22 and parallel to the apron 19. This second side extension 24 is parallel to the ground. The second side extension 24 extends downstream from the second portion 22 of the first upstream transverse element 17. The second side extension 24 extends upstream from the second portion 22 of the second downstream transverse element 18.

The frame 13 and thus the module 6 comprise at least one foot 26 fixed to the transverse element 17 and 18 in the region of the second portion 22. The foot 26 is fixed to the second side extension 24 and ensures the positioning on the ground and the horizontality of the transverse element 17 and 18 and thus of the frame 13.

For additional rigidity, a fold forming a third side extension 27 is provided (see FIG. 3) in the region of the inner end of the second side extension 24 of the transverse element 17 and 18. The third side extension 27 extends perpendicular to the second side extension 24 and parallel to the second portion 22. The third side extension 27 is oriented vertically and directed upwards.

In the principal embodiment relating to the embossing module 6, a first functional arrangement is a device for embossing braille characters 28. The embossing module 6 may comprise two embossing devices 28 arranged on the side of the front wall 14 and on the side of the rear wall 16 of the frame 13.

The embossing device 28 comprises, in particular, an upper male rotating embossing tool 29 and a lower female rotating embossing tool 31, the two tools 29 and 31 being mounted in rotation (see document EP 1932657). The male tool 29 is formed by a cylinder, the peripheral surface thereof being a metal plate provided with pins and wrapped around the cylindrical tool. The female tool 31 consists of a cylinder, the peripheral surface thereof being provided with depressions. The blanks travel between the two tools 29 and 31.

This first functional arrangement, i.e. the device for embossing 28, is held by the frame 13. When the embossing device 28 is located on the side of the front wall 14, the tools 29 and 31 are oriented so as to overhang to the rear. When the embossing device 28 is located on the side of the rear wall 16, the tools 29 and 31 are oriented so as to overhang to the front.

The shape and the strength of the apron 19 are such that an operator 30 (only the shoes are shown in FIG. 2) is able to climb onto this apron 19 and thus onto the frame 13 and to access easily the device for embossing with braille characters 21. For example, the operator 30 will easily climb onto the apron 19 of the frame 13 to install the tools 29 and 31, to position them at an angle and transversely and then to fix them to their respective rotational shaft, and for further operations.

The functional arrangement, i.e. the embossing device 28, is held as a result of the two elements 17 and 18 of the frame 13. To achieve this, the module 6 may comprise at least one rail 32 mounted in the region of the frame 13, in particular on the transverse element 17 and 18, and more particularly on the upper face of the apron 19 (see FIGS. 2 and 3). Two rails 32 parallel to one another are provided in the preferred embodiment. The upstream transverse element 17 comprises an upstream rail 32. The downstream transverse element 18 comprises a downstream rail 32. They are parallel to the slot 21, being positioned on both sides thereof. The two rails 32 extend transversely in a planar manner and are centered relative to the walls 14 and 16 and relative to the frame 13.

The embossing device 28 comprises a lower part having a profile which is complementary to the profile of the rails 32. As a result, the embossing device 28 is capable of sliding on the two rails 32. This sliding permits an adjustment of the transverse position of the embossing device 28 relative to the direction of travel of the blanks. With this transverse adjustment and with the embossing device 28 on the side of the front wall 14 and/or the embossing device 28 on the side of the rear wall 16, it is possible to emboss braille characters over the entire surface of the blanks traveling in the folder-gluer 1.

Advantageously, the functional arrangement, i.e. the embossing device 28, comprises a lower support (not shown) passing through the slot 21. The lower support is mechanically connected to means for holding and means for transverse translation of the embossing device 28, of the shaft and drive motor type, located below the apron 19 of each of the transverse elements 17 and 18.

In the principal embodiment relating to the embossing module 6, a second functional arrangement is a conveyor 33 (see FIG. 4). The blanks are held during the embossing of braille characters. The module 6 comprises two conveyors 33 arranged on the side of the front wall 14 and on the side of the rear wall 16 of the frame 13.

The conveyor 33 is carried by a framework 34 similar to a vertical plate, arranged between the front 14 and rear 16 walls of the frame 13. The framework 34 and thus the conveyor 33 are mobile transversely so as to be able to be brought closer to or moved away from the front wall 14 and/or rear wall 16.

The conveyor 33 comprises a lower endless conveyor belt 36 and an upper endless conveyor belt 37. The upper conveyor belt 37 is guided by upper rollers and driven by friction by the lower conveyor belt 36. The conveyor belts 36 and 37 are pressed against one another. The blanks are held and driven in the direction of travel F between the lower conveyor belt 36 and the upper conveyor belt 37.

The functional arrangement, i.e. the conveyor 33, comprises a lower support 38 (dashed lines in FIG. 4) passing through the slot 21. The lower support 38 is mechanically connected to means for holding and means for transverse translation of the conveyor 33, of the shaft and drive motor type, located below the apron 19 of each of the transverse elements 17 and 18.

The apron 19 is shaped so as to permit an operator 30 to climb onto the frame 13 and access the conveyor 33. For example, the operator 30 will easily climb onto the apron 19 of the frame 13 to change the rollers, the belts 36 and 37 and for further operations.

By way of example for the module 6, the apron 19 is located at a height substantially between 350 mm and 500 mm, for example substantially equal to 450 mm. The means for holding and means for transverse translation of the embossing device 28 and the means for holding and the means for transverse translation of the conveyor 33 are located below the apron 19.

To facilitate access to the apron 19, the module 6 and thus the frame 13 advantageously comprise a footboard 39 mounted in the region of the front wall 14. The footboard 39 overhangs to the front.

The present invention is not limited to the embodiments disclosed and illustrated. Numerous modifications may be implemented without departing from the meaning of the invention defined by the scope of the claims.

The invention claimed is:

1. A module for a folder-gluer for manufacturing packaging boxes comprising:

a frame having a vertical front wall and a vertical rear wall spaced from the front wall, wherein a direction lengthwise of the front and rear walls forming a longitudinal direction of said frame, the vertical front wall and the vertical rear wall being provided respectively with upper edges;

at least one functional device mounted on the frame at a level which is at or above the upper edges of the front and rear walls;

the frame further comprises at least one transverse connecting element, extending between the front wall and the rear wall and mechanically connecting the front wall with the rear wall and maintaining parallelism between the front wall and the rear wall, the transverse connecting element comprising at least one horizontal apron at or below a level of the functional device mounted on the frame and extending horizontally away from the functional device in a lateral direction which is transverse to said longitudinal direction, the at least one horizontal apron being flush with the upper edge of one or both of the vertical front wall and the vertical rear wall, and extending in the longitudinal direction to provide a space at or below the level of the functional device, thereby permitting an operator to stand on said space on the apron to access the functional device held by the frame adjacent to one of the front wall or the rear wall of the frame;

wherein the functional device is mounted on at least one rail which is mounted on the at least one transverse connecting element, the at least one rail extending in said transverse direction and above the level of said apron; and wherein the functional device has a lower part to move in the transverse direction on the at least one rail to said one of the front wall or the rear wall.

2. A module according to claim 1, comprising two of the transverse connecting elements configured and being capable of holding the functional device.

3. A module according to claim 2, wherein the elements are separated laterally from one another, leaving a transverse slot between them.

4. A module according to claim 3, wherein the functional device comprises a lower support passing through the slot.

5. A module according to claim 1, wherein the functional device is a conveyor.

6. A module according to claim 1, wherein the functional device is a device for embossing braille characters on blanks passing the functional device.

7. A module according to claim 6, further comprising at least one rail which is mounted on the at least one transverse connecting element and extending in said transverse direction, wherein the embossing device comprises a lower part configured for sliding on the at least one rail.

8. A module according to claim 1, wherein the at least one transverse connecting element is in the form of a folded plate.

9. A module according to claim 1, wherein the at least one transverse connecting element has a profile substantially in the shape of a reverse L-shape, comprising a first portion thereof forming the apron and a second substantially vertical portion.

10. A module according to claim 9, further comprising at least one foot fixed to the at least one transverse connecting element in a region of the second portion of the at least one transverse connecting element.

11. A module according to claim 1, further comprising a footboard mounted in the region of the front wall.

12. A folder-gluer, comprising at least one module according to claim 1.

13. A folder-gluer according to claim 12, wherein the functional device in the module is a device for embossing braille characters on blanks passing the module in the folder-gluer.

* * * * *